United States Patent [19]

Weiss

[11] Patent Number: 4,733,851

[45] Date of Patent: Mar. 29, 1988

[54] STOR-A-WAY FENCES

[76] Inventor: Paul J. Weiss, 56 S. Walnut St., Wilkes-Barre Township, Luzerne County, Pa. 18702

[21] Appl. No.: 6,770

[22] Filed: Jan. 27, 1987

[51] Int. Cl.[4] ..... E04H 17/14

[52] U.S. Cl. ..... 256/60; 256/19; 256/27

[58] Field of Search ..... 256/60, 73, 19, 61, 256/62, 27

[56] References Cited

U.S. PATENT DOCUMENTS

| | | | |
|---|---|---|---|
| 508,573 | 11/1893 | Jester et al. | 256/73 X |
| 2,603,456 | 7/1952 | Ruopp | 256/60 |
| 3,265,364 | 8/1966 | Frye | 256/19 |
| 4,498,660 | 2/1985 | Brema et al. | 256/19 |

*Primary Examiner*—Andrew V. Kundrat

[57] ABSTRACT

A foldable fence including a plurality of fence sections pivoted of posts therebetween, each section comprising spaced apart rails that interfit at their ends with the ends of adjacent sections.

4 Claims, 5 Drawing Figures

FIG. 1
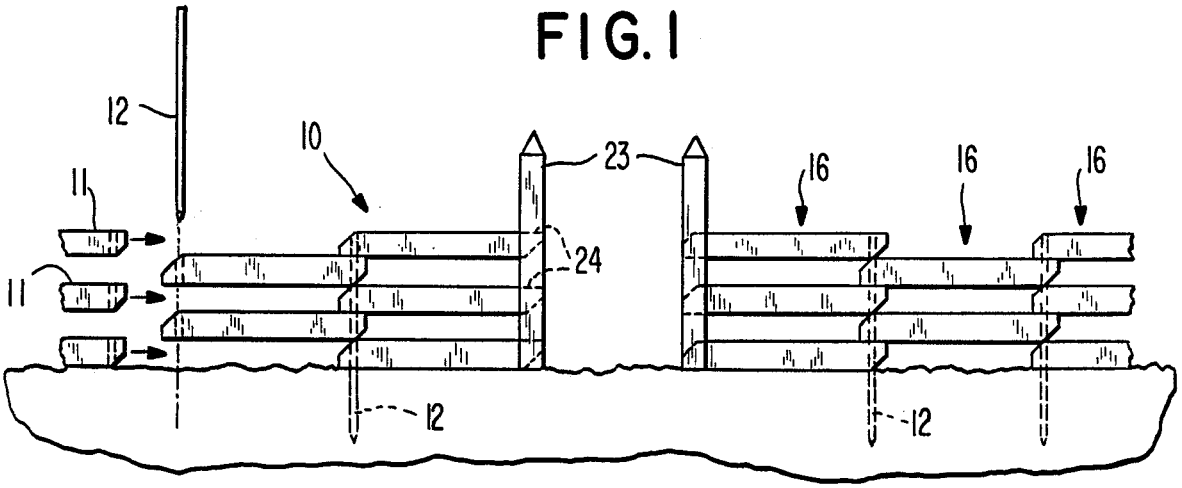
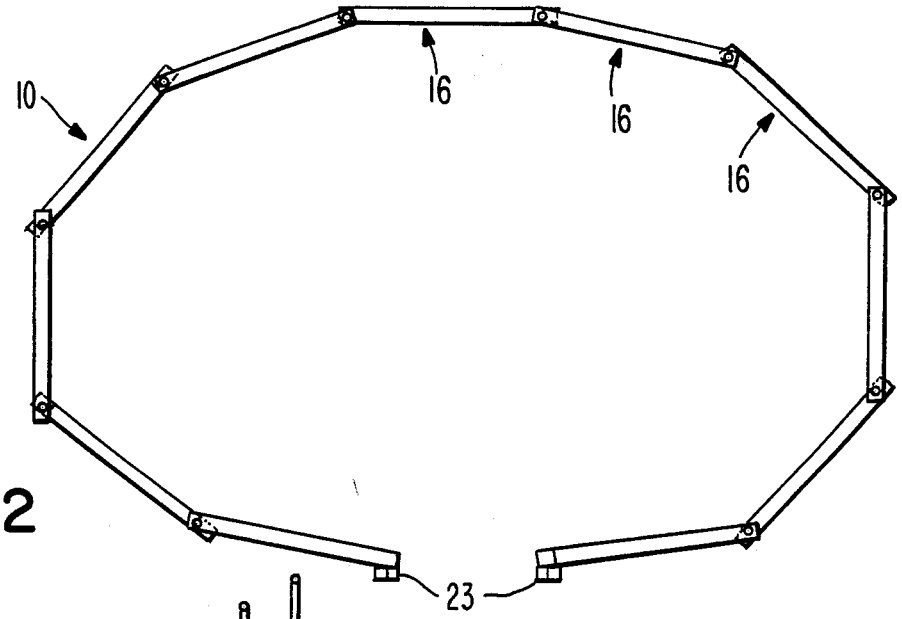
FIG. 2
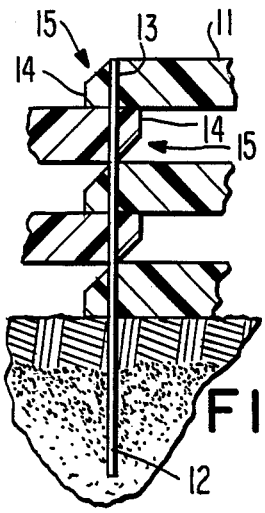
FIG. 4
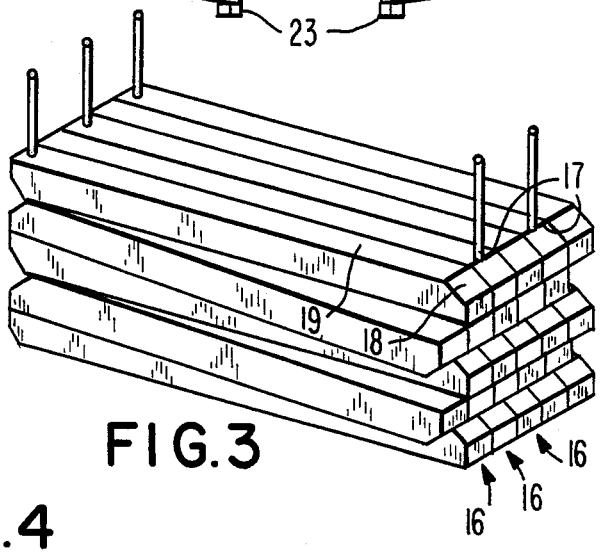
FIG. 3
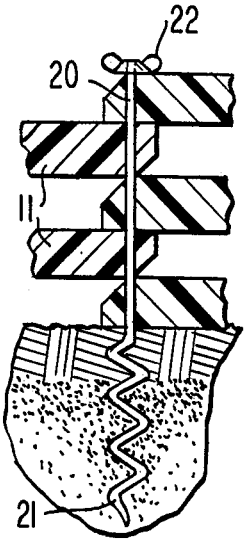
FIG. 5

STOR-A-WAY FENCES

BACKGROUND OF THE INVENTION

1. Field of the Invention

This invention relates generally to fences used for dividing areas. More specifically, it relates to decorative fencing such as may be quickly and easily set up whenever needed.

2. Description of Prior Art

It is well known that numerous designs of fences have been developed in the past that are particularly for temporary use and which are readily easy to set up, such as for bordering a planned garden path, surrounding a new planting or the like, and which afterwards may be removed. Most such fencing while not in use, takes up a great deal of storage space which otherwise could be used for other purposes. This situation is therefore in need of an improvement.

SUMMARY OF THE INVENTION

Accordingly, it is a principal object of the present invention to provide a fence that can be readily stored away within a minimum space by being foldable so to be stacked.

Another object is to provide a stor-a-way fence which can be easily dismantled so that it may be made to be longer or shorter as needed.

Yet another object is to provide a stor-a-way fence which can be readily bent up into any set up shape.

Still another object is to provide a stor-a-way fence which can be made in any desired size for use also decoratively indoors such as around a Christmas tree.

These and other objects will be immediately evident upon a study of the following Specification and the accompanying Drawing.

BRIEF DESCRIPTION OF THE DRAWINGS

FIG. 1 is a fragmentary front elevational view of stor-a-way fence, shown in accordance with the present invention;

FIG. 2 is a top plan view of the invention illustrating one typical fence pattern;

FIG. 3 is a perspective view of the invention folded for storage;

FIG. 4 is a fragmentary sectional view of the dowel and fence fastener used also to hold the fence in place in the ground, and FIG. 5 is a fragmentary sectional view of another embodiment of the preferred embodiment shown in FIGS. 1 to 4, except having a corkscrew end on the dowel to hold in sandy soil having a wing nut for turning at the opposite end.

DETAILED DESCRIPTION

Referring now to the Drawing in greater detail, and more particularly to FIGS. 1 to 4 thereof, at this time, the reference numeral 10 represents a stor-a-way fence incorporating the invention, wherein there are a plurality of horizontal fence rails 11 and a plurality of vertical fence posts 12 which supports the rails in set up position.

The fence rails may be made either of wood or molded plastic and in sets of any size according to intended uses. Each rail has an opening 13 in each end thereof for receiving a pin or dowel that serves as the fence post 12. The rails are preferably square in cross-sectional configuration so that they may be readily stacked one upon another. Each square end 14 includes a "cut-off" angled corner 15 for easily fitting mating ends of the rails together; an angled corner of one rail being adjacent an angled corner of an adjacent rail thereabove or therebelow, so that when assembled together, each rail section 16, comprised of several rails 11 spaced one above another, can be effortlessly pivoted respective to an adjacent rail section by means of the rails being axially slidable a little bit along the post in order to prevent them getting pivotally hung-up together such as when trying to fold up a fence into the stored away position, shown in FIG. 3. It is to be noted that the post opening 13 intercepts the edge 17 located between the "cut-off" corner angled face 18 and along horizontal face 19 of each rail. Thus the edge 17 of one rail aligns with edge 17 of an adjacent rail when the rail sectionals are in a straight line.

The posts may be made either of metal or wood, and for out-of-doors use they may be made longer than the height of the fence so that a lower end of the posts may be inserted into the ground.

In a modified design of fence post 20, shown in FIG. 5, the lower end 21 of the post may be spiralled like a corkscrew for holding in sandy or loose soil. A wing nut 22 is affixed on the post upper end for easy turning of the post when inserting or removing from the ground.

In use, the fence may be erected into any straight or curved direction, as shown in FIG. 2. The fence length may be lengthened by removing a post and adding fence sections. The angled corner 15 permits quick and easy fitting of new rail ends into the spaces between rails of existing rail sections when making a longer fence.

As shown in FIGS. 1 and 2, a pair of gate posts 23 may be included with each fence set; each fence post comprising a relatively thick dowel having spaced apart holes 24 along a side thereof for insertion of rail ends that are frictionally held therein.

As shown in FIG. 3, the fence in stored away position fits compactly in a minimum space.

While various changes may be made in the detail construction, it is understood that such changes will be within the spirit and scope of the present invention as is defined by the appended claims.

What I now claim is:

1. A storable fence, comprising, in combination, a plurality of fence sections pivotally joined together, each said fence section comprising a plurality of horizontal fence rails spaced one above another, and a plurality of fence posts for connection of said fence sections together, each fence rail having a cut angled corner angled from a horizontal face of the rail, and each fence rail having an opening transversly there through it at each end thereof located at the edge between the angled cut off face and the horizontal face for fence posts to extend there through.

2. The combination as set forth in claim 1, wherein a pair of gate posts are included with said fence, each said gate post having a plurality of holes for insertion of the fence rail ends thereinto.

3. The combination as set forth in claim 1, wherein each fence post has a corkscrew configuration at the bottom thereof for holding in sandy or loose soil.

4. The combination as set forth in claim 1, wherein each fence post has a wingnut affixed to the upper end thereof for easy turning of the post when inserting or removing from the ground.

* * * * *